US009695583B2

(12) United States Patent
Durkin

(10) Patent No.: US 9,695,583 B2
(45) Date of Patent: Jul. 4, 2017

(54) FLUSH TOILET WITH BUILD-IN ONE-WAY VALVE SYSTEM FOR USE IN UNCLOGGING CLOGS AND FOR EFFICIENT WATER-SAVING FLUSH OPERATIONS AND RELATED METHODS

(71) Applicant: Shane Durkin, La Jolla, CA (US)

(72) Inventor: Shane Durkin, La Jolla, CA (US)

( * ) Notice: Subject to any disclaimer, the term of this patent is extended or adjusted under 35 U.S.C. 154(b) by 0 days.

(21) Appl. No.: 14/959,284

(22) Filed: Dec. 4, 2015

(65) Prior Publication Data

US 2016/0083950 A1 Mar. 24, 2016

Related U.S. Application Data

(63) Continuation-in-part of application No. 13/944,781, filed on Jul. 17, 2013, now Pat. No. 9,234,339.

(51) Int. Cl.

| | |
|---|---|
| ***E03D 11/10*** | (2006.01) |
| ***E03D 9/00*** | (2006.01) |
| ***E03D 5/01*** | (2006.01) |
| ***E03D 11/00*** | (2006.01) |
| *E03F 9/00* | (2006.01) |
| *E03C 1/308* | (2006.01) |

(52) U.S. Cl.

CPC ..... *E03D 9/00* (2013.01); *E03D 11/00* (2013.01); *E03C 1/308* (2013.01); *E03F 9/00* (2013.01)

(58) Field of Classification Search

CPC . E03C 1/30; E03C 1/304; E03C 1/308; E03D 9/00; E03D 11/00; E03D 11/02; E03D 11/10; E03D 5/01; E03F 9/00

USPC ..... 4/255.01–255.04, 255.06, 426, 427

See application file for complete search history.

(56) References Cited

U.S. PATENT DOCUMENTS

| | | | | |
|---|---|---|---|---|
| 1,885,977 | A | 11/1932 | Denison | |
| 1,924,498 | A | 8/1933 | Hammond | |
| 1,938,064 | A | 12/1933 | Carmine | |
| 4,115,883 | A | 9/1978 | Dauvergne | |
| 4,538,307 | A | 9/1985 | Barnum et al. | |
| 4,745,641 | A | 5/1988 | Tash | |
| 4,819,279 | A | 4/1989 | Sigler et al. | |
| 4,847,923 | A | 7/1989 | Huang | |
| 5,852,834 | A | 12/1998 | Harvey | |
| 5,862,534 | A | 1/1999 | Clay | |
| 5,963,994 | A | 10/1999 | Harvey | |
| 6,067,668 | A | 5/2000 | Rudd | |
| 6,205,594 | B1 | 3/2001 | Solaberry | |
| 6,216,285 | B1 * | 4/2001 | Olin | E03F 1/006 4/321 |
| 6,643,854 | B1 | 11/2003 | Jensen | |
| 6,668,389 | B1 | 12/2003 | Steinmetz et al. | |
| 8,104,102 | B2 | 1/2012 | O'Hanley | |

(Continued)

*Primary Examiner* — J. Casimer Jacyna

(74) *Attorney, Agent, or Firm* — Buche & Associates, P.C.; John K. Buche; Bryce A. Johnson

(57) ABSTRACT

In general, a flush toilet with a built-in clog removal system is described. Additionally, a flush toilet with a one-way valve system for efficient and water conserving operation is disclosed. In one embodiment, the disclosed toilet is defined by: a bowl connected to an drain pipe; at least one one-way valve positioned pipe; and a pump in fluid communication with the pipe so that (a) initiating the pump to force the piston downward or upward causes fluid-flow in the pipe so that the one-way valve closes or opens as a result of pressure or a vacuum against debris clogging the drain.

2 Claims, 10 Drawing Sheets

(56) References Cited

U.S. PATENT DOCUMENTS

| | | | |
|---|---|---|---|
| 8,756,721 | B1 | 6/2014 | Dewey |
| 2008/0244819 | A1 | 10/2008 | Meador |
| 2009/0211008 | A1 | 8/2009 | Fucito |

* cited by examiner

FLUSH TOILET WITH BUILD-IN ONE-WAY VALVE SYSTEM FOR USE IN UNCLOGGING CLOGS AND FOR EFFICIENT WATER-SAVING FLUSH OPERATIONS AND RELATED METHODS

CROSS-REFERENCE TO RELATED APPLICATIONS

This application is a continuation-in-part of U.S. patent application Ser. No. 13/944,781 filed on Jul. 17, 2013, entitled "Flush Toilet with Built-In Unclogging System and Related Methods."

STATEMENT REGARDING FEDERALLY SPONSORED RESEARCH OR DEVELOPMENT

Not applicable.

BACKGROUND OF THE INVENTION

Field of Invention

This invention is in the field of flush toilets.

Background of the Invention

Toilets are sanitation fixtures used for the disposal of waste, including human excrement and urine. Flush toilets are a common type of toilet that are defined by a bowl that is connected to a hollow and upside-down "U" shaped drain pipe plus a reservoir of water for rapidly filling the bowl. Flushing is accomplished by causing a rapid influx of water from the reservoir into the bowl so that a siphon of water and waste is created through the drain.

Additionally, the conventional method of flushing a toilet is wasteful because it requires a significant amount of fresh and potable water from the reservoir in order to force the water in the bowl over the "U" shaped drain to initiate a siphon effect and complete a flush.

Occasionally, drains become clogged. Modern flush toilets are particularly susceptible to clogging because the same are designed to use less water per flush (toilets that use less water are dubbed "eco-friendly"). Various apparatus and methodologies are known for unclogging toilets. One popular apparatus is a plunger, which consists of a rubber cup at the end of a shaft. In operation, the cup may be pushed over the mouth of the clogged drain until the cup is flattened so that, when pulled out, a vacuum is created within the drain to disrupt the clog.

Although useful for unclogging drains, plungers have a few unsatisfactory aspects. For instance, plungers are unsanitary because they frequently contact waste (e.g., fecal matter or urine). Also, plunging can cause splashing of the waste outside of the toilet bowl or on the user. Furthermore, plungers are not always available for unclogging a toilet and their acquisition can be compromising or embarrassing. Accordingly, there is a need for improved apparatus and related methodologies for unclogging a toilet drain without the unsatisfactory aspects of plungers.

SUMMARY OF THE INVENTION

Accordingly, it is an object of the present invention to provide a flush toilet with a built-in unclogging mechanism. In one embodiment, the disclosed toilet is defined by: a bowl connected to an upside-down "U" shaped drain; two one-way valves in series positioned in a downward portion of the "U" shaped pipe; and a piston pump in fluid communication with the downward portion of the U shaped pipe so that initiating the pump to force the piston downward or upward causes fluid-flow in the downward section of the pipe between the one-way valves so that one of the two one-way valves closes and the other of the two one-way valves opens. In operation, moving fluid (air or liquid) through the downward portion of the drain pipe, and the opening and closing of either of the one-way valves will result in pressure or a vacuum against debris clogging the drain.

It is another object of the present invention to provide an efficient and water conserving toilet. In one embodiment, the disclosed toilet is defined by: a bowl connected to an upside-down U-shaped drain; two one-way valves in series, positioned in a downward portion of the U-shaped pipe; and a piston pump in fluid communication with the downward portion of the U-shaped pipe so that initiating the pump to force the piston downward or upward causes fluid-flow in the downward section of the pipe between the one-way valves so that one of the two one-way valves closes and the other of the two one-way valves opens. In operation, moving fluid (air or liquid) through the downward portion of the drain pipe and the opening and closing of the one-way valves will result in a vacuum that will pull the water in the bowl over the U-shaped drain, thus initiating a complete, powerful flush with only a minimal use of water from the reservoir (tank) to clean the interior of the toilet bowl.

BRIEF DESCRIPTION OF THE FIGURES

Other objectives of the invention will become apparent to those skilled in the art once the invention has been shown and described. The manner in which these objectives can be achieved is explained in the following description and attached figures in which.

It is to be noted, however, that the appended figures illustrate only typical embodiments of the disclosed apparatus and are therefore not to be considered limiting of its scope, for the invention may admit to other equally effective embodiments that will be appreciated by those reasonably skilled in the relevant arts. Also, figures are not necessarily made to scale.

DETAILED DESCRIPTION OF PREFERRED EMBODIMENTS

In general, a flush toilet with a built-in clog removal system is disclosed. In one embodiment, the disclosed toilet is defined by: a bowl connected to a drain pipe; at least one, one-way valve positioned in a pipe; and a pump in fluid communication with the pipe so that initiating the pump to force the piston downward or upward causes fluid-flow (air or liquid) in the pipe so that the one-way valve closes or opens as a result of pressure or a vacuum against debris clogging the drain. The more specific aspects of the invention are disclosed with reference to the figures.

Figure 1:
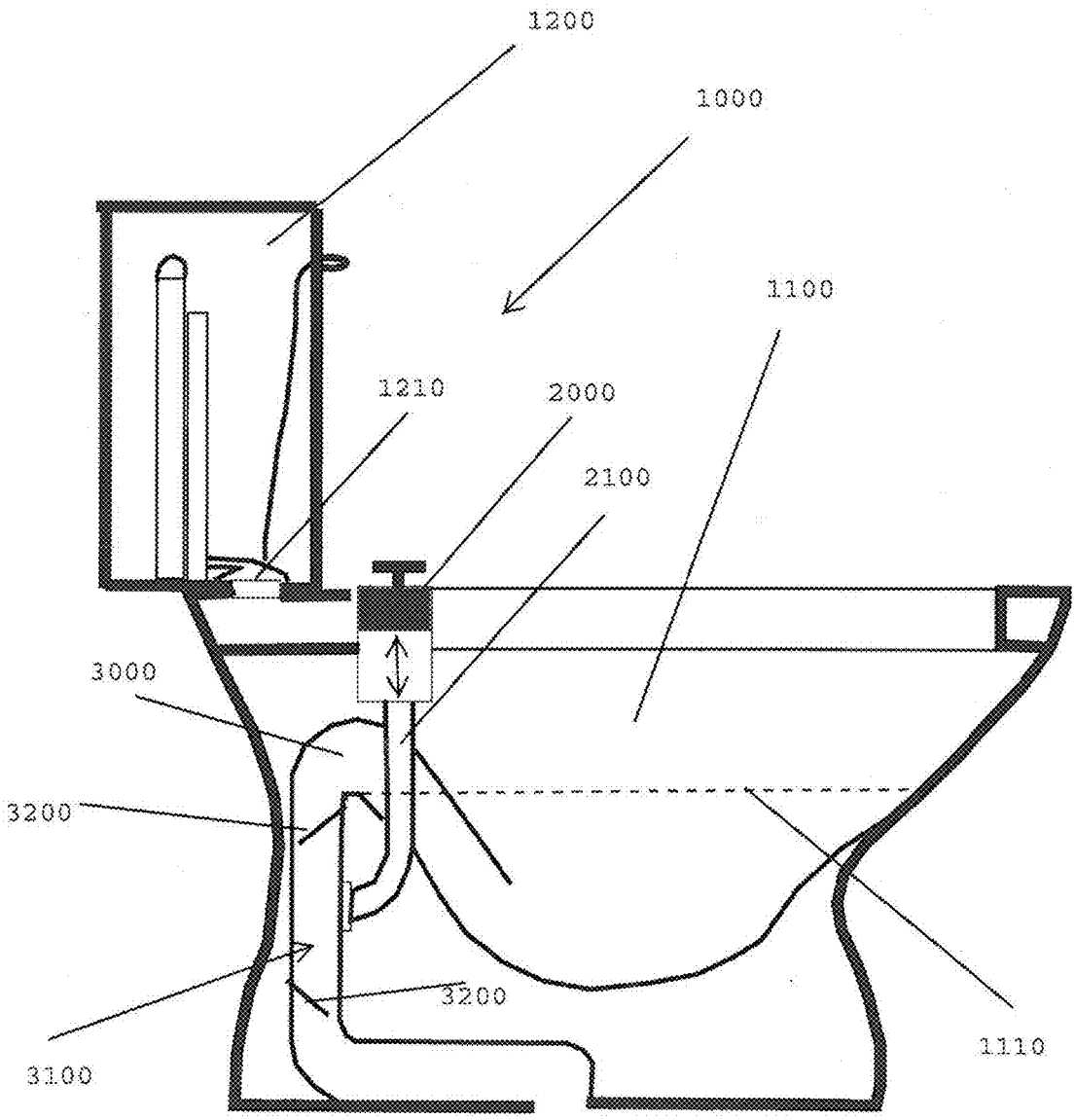
FIG. 1 cross-section of an embodiment of a flush toilet 1000 with built-in unclogging system.
Figure 2:
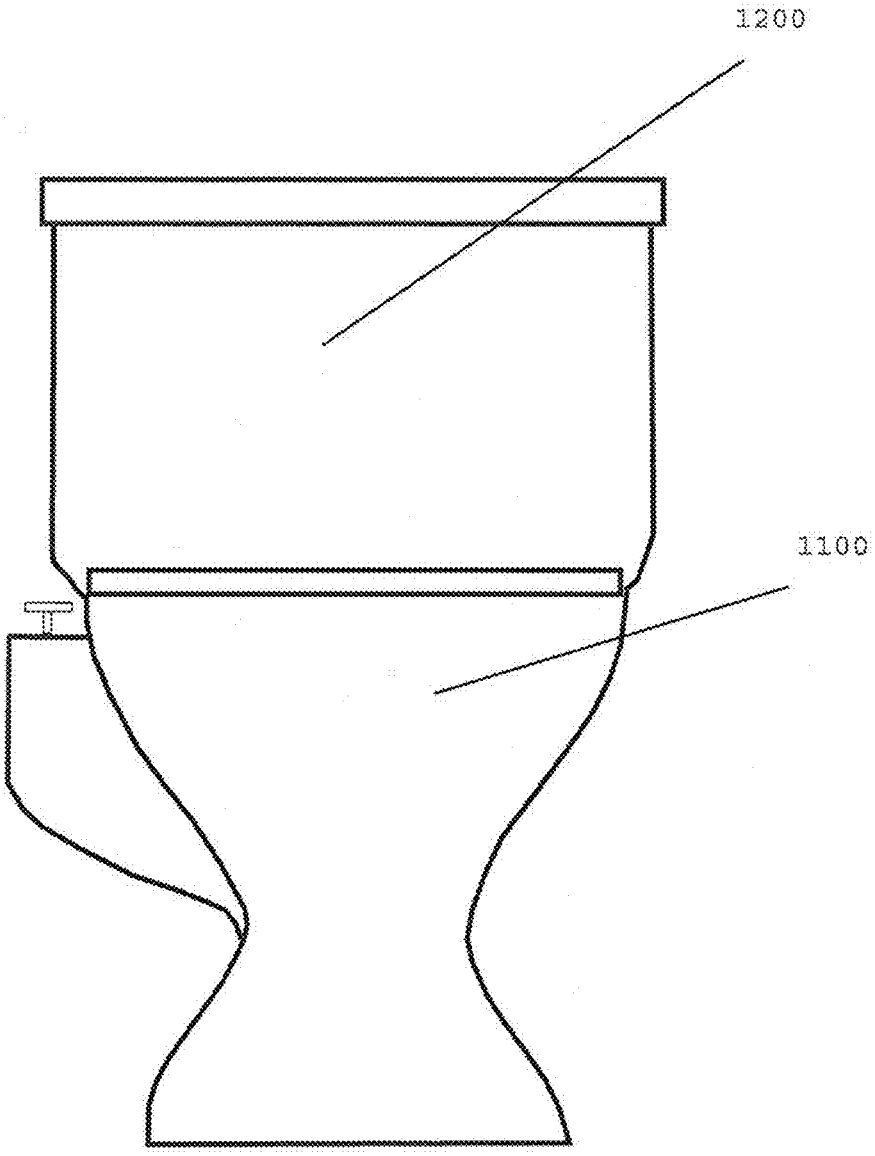
FIG. 2 is a front view of the toilet 1000 of FIG. 1.
Figure 3:
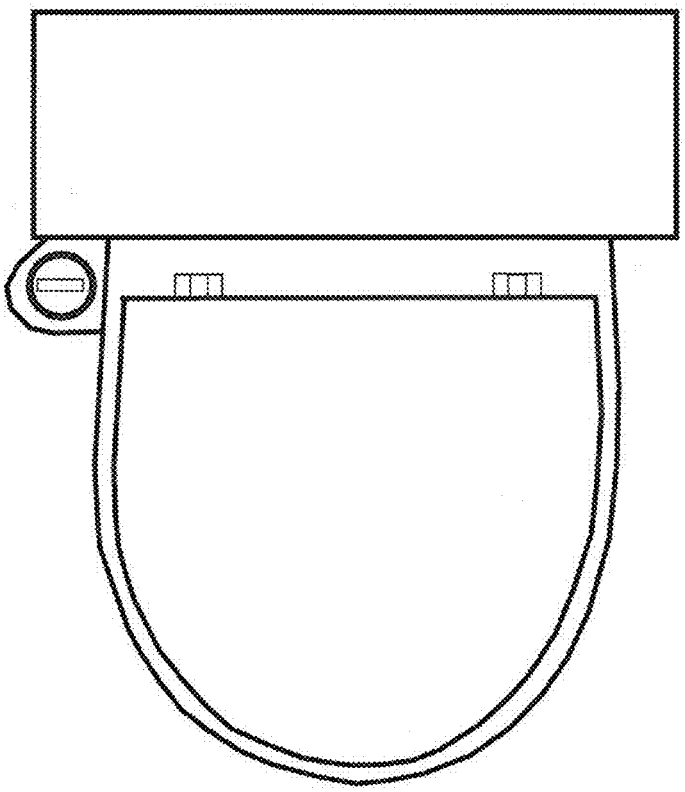
FIG. 3 is a top view of the toilet 1000 of FIG. 1.

FIG. 1 is a cross section of a flush toilet 1000 with a built-in clog removal system. FIGS. 2 and 3 are front and top views of the toilet 1000 shown in FIG. 1. Referring to FIGS. 1 through 3 the toilet 1000 is defined by a bowl 1100 that is coupled to a water tank 1200 and in fluid communication with a hollow and upside-down "U" shaped drain pipe 3000. As shown in FIG. 1, the water tank 1200 is vertically superior to the bowl and features an opening with a stopper 1210 wherein unstopping the opening causes water within the water tank 1200 to rapidly flow into the bowl 1100. Suitably, the bowl 1100 initially features a water level 1110 that does not empty through the drain 3000. Preferably, any rapid influx of water from the water reservoir 1200 into the bowl 1100 may increase the water level 1110 to result in a siphon through the U shaped drain 3000.

Still referring to FIG. 1, the toilet further comprises a pump 2000 that is in fluid communication with a downward portion 3100 of the U-shaped drain pipe 3000. In operation the pump may be used to cause fluid-flow (air or liquid) inside the downward portion 3100 of the drain pipe. In a preferred embodiment, the pump 2000 is a piston pump, which is provided to an air pipe 2100 that is coupled to the downward portion 3100 of the drain 3000. In said embodiment, a screen may be provided to the coupling of the air pipe with the drain so that debris may be prevented from entering the air pipe. It is contemplated, however, that any type of pump may be employed without departing from the spirit and intent of this disclosure.

Figure 5:
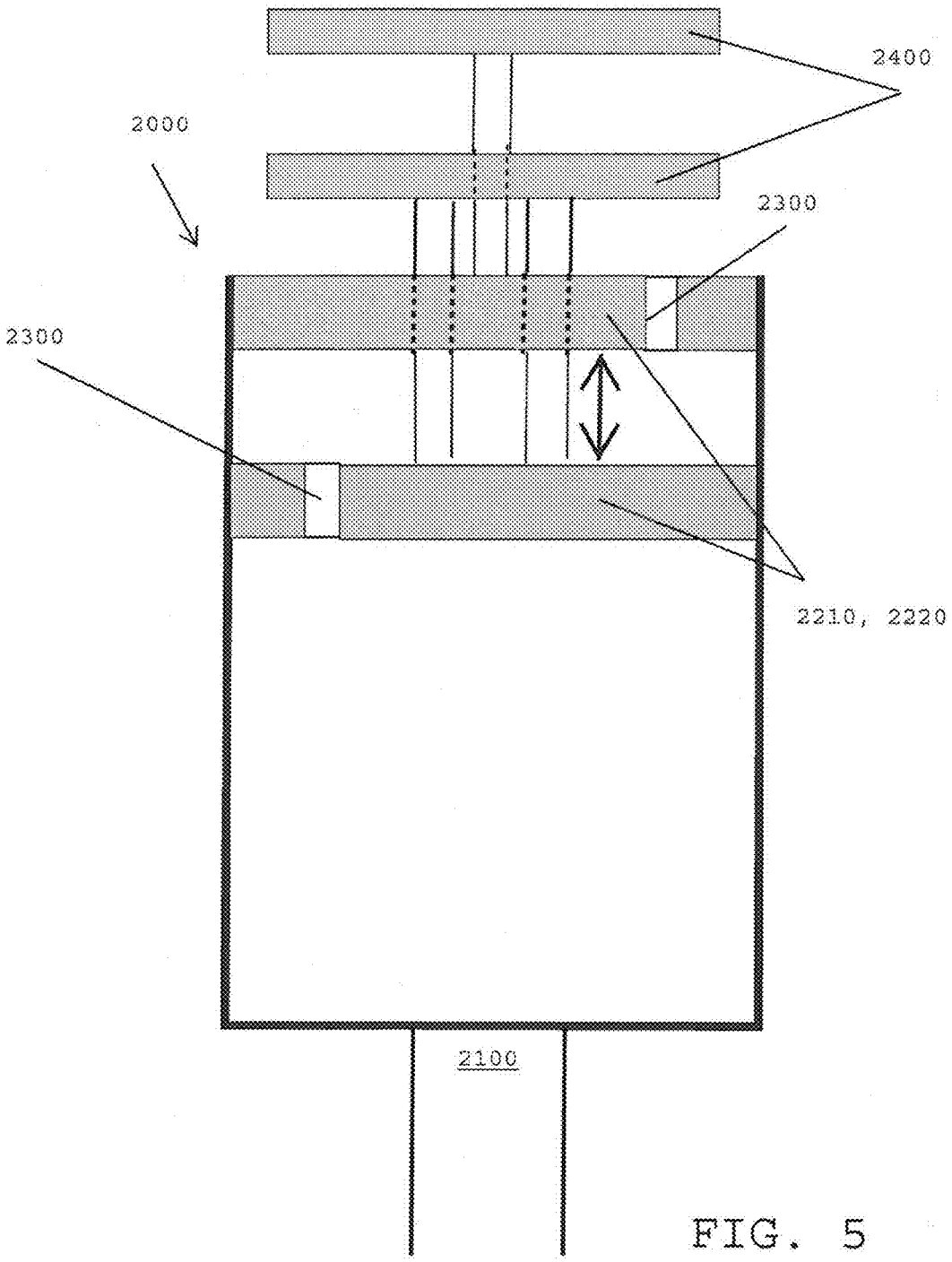
FIG. 5 is a cross-section of a piston pump for operating the disclosed toilet.

FIG. 5 is a cross section of the pump 2000. As shown, the pump may be a piston pump for causing air flow (whether by force or suction) inside the downward portion 3100 (shown in FIG. 1) of the drain 2000. From time-to-time operations of the pump may not be necessary and, as a result, the pump may be deactivated. In the disclosed embodiment, the pump 2000 comprises a piston 2200 that is suitably divided into upper and lower portions 2210, 2220. Suitably the upper and lower portions are movable relative to one another via respective upper and lower handles 2400 that are mechanically interconnected respectively therewith. As shown, the upper and lower portions respectively feature air-inlets 2300 that are closed by interfacing the upper and lower portions 2210, 2220. With the air inlets closed, the pump may be operated in the known manner to produce air-flow within the drain pipe.

Referring back to FIG. 1, the toilet 1000 comprises an upside-down "U" shaped drain pipe 3000 with a downward portion 3100. The pipe 3000 preferably features two one-way valves 3200, or at least one one-way valve 3200. As shown, the pipe 3000 features two one-way valves in the downward portion 3100 of the pipe 3000. Suitably, the valves operate to open or close the drain pipe 3000. As discussed in greater detail below, the valves operate in response to fluid-flows (preferably air but may also be a liquid) generated via the pump 2000.

Figure 4:
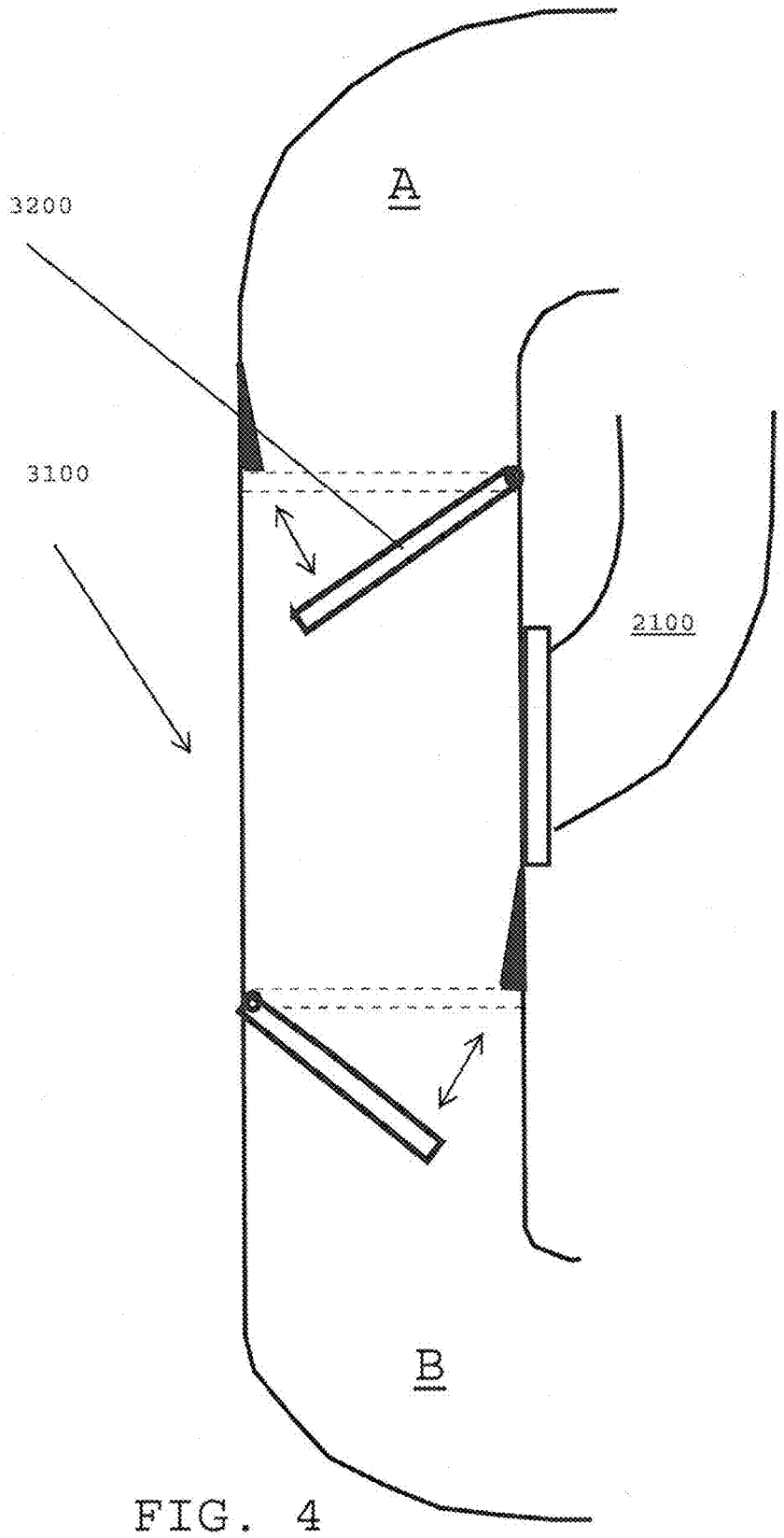
FIG. 4 is a cross section of a downward portion of a drain pipe.

FIG. 4 is a cross section of the downward portion 3100 of the drain pipe 3000. As shown, the drain features two one way valves, one at a level that is vertically superior to the coupling of the drain 3000 to the air-pipe 2100 of the pump, and one at a level that is vertically inferior to said coupling. When so configured, air flow from the pump 2000 through the air pipe 2100 to within the drain 3000 may close the vertically superior valve and, as a result, apply pressure to a clog occurring within the drain down system of the air pipe. When so configured, fluid flow to the pump 2000 from within the drain may close (illustrated in broken lines in FIG. 4) the vertically inferior valve and, as a result, apply vacuum suction to a clog occurring within the drain up system of the air pipe. In other words, sending air through the air pipe 2100 closes one of the valves and, as a result, charges the pump to create pipe-flow by pressure or vacuum suction.

In use, the toilet 1000 generally flushes in the manner known to those skilled in the art of flush toilets. Occasionally, the drain 3000 of the toilet 1000 may become clogged and the pump 2000 may be used to unclog the drain 3000. In a preferred mode of pump operation, a user, referring to FIG. 5, may raise the lower portion 2210 of the piston 2200 relative to the upper portion 2220 of the piston 2200 so that an interface therebetween is established for closing the air-intake holes 2300. After the Air-intake holes 2300 are closed, the pump handle 2400 may be manipulated to drive air into the drain or draw air from the drain 3000 via the air pipe 2100. Referring now to FIG. 4, air flow from the pump 2000 to within the drain may close a vertically superior valve 3200 and, as a result, apply pressure to a clog occurring within the drain 3000 down system of the air pipe 2100 while air flow to the pump from within the drain 3000 may close a vertically inferior valve 3200 and, as a result, apply vacuum suction to a clog occurring within the drain 3000 up system of the air pipe 2100. Suitably, clogs may be removed from the drain by repeatedly causing pressurizing or vacuumizing air flow in the drain 3000 via operation of the pump 2000. In other words, a clog may be pushed or pulled through the pipe to end the clog.

Exemplary Usage 1.

Referring to FIG. 4, a user may experience a clog at point A. To remove the clog, a user may first activate the pump 2000 by, as discussed in connection with FIG. 5, creating an interface between the upper and lower portions 2210, 2220 of the piston 2200 so that the air intake holes 2300 are closed. After the air holes 2300 are closed, the pump handle 2400 may be manipulated to draw air from the drain 3000 (not shown in FIG. 5) via the air pipe 2100. Referring to FIG. 4, air flow from the drain 3000 to within the pump 2000 (not shown in FIG. 4) via the air pipe 2100 may close the lower valve 3200 and, as a result, apply vacuum suction to the clog A. Suitably, the clogs may be removed from the drain by repeatedly causing vacuumizing air flow in the drain via operation of the pump.

Exemplary Usage 2.

Referring to FIG. 4, a user may experience a clog at point B. To remove the clog B, a user may first activate the pump 2000 by, as discussed in connection with FIG. 5, creating an interface between the upper and lower portions 2210, 2220 of the piston 2200 so that the air intake holes 2300 are closed. After the air holes 2300 are closed, the pump handle 2400 may be manipulated to force air into the drain 3000 (not shown in FIG. 5) via the air pipe 2100. Referring to FIG. 4, air flow from the pump 2000 (not shown in FIG. 4) to within the drain 3000 via the air pipe 2100 may close the upper valve 3200 and, as a result, apply pressure to the clog B. Suitably, the clogs may be removed from the drain by repeatedly causing forced air flow in the drain via operation of the pump.

Figure 6:
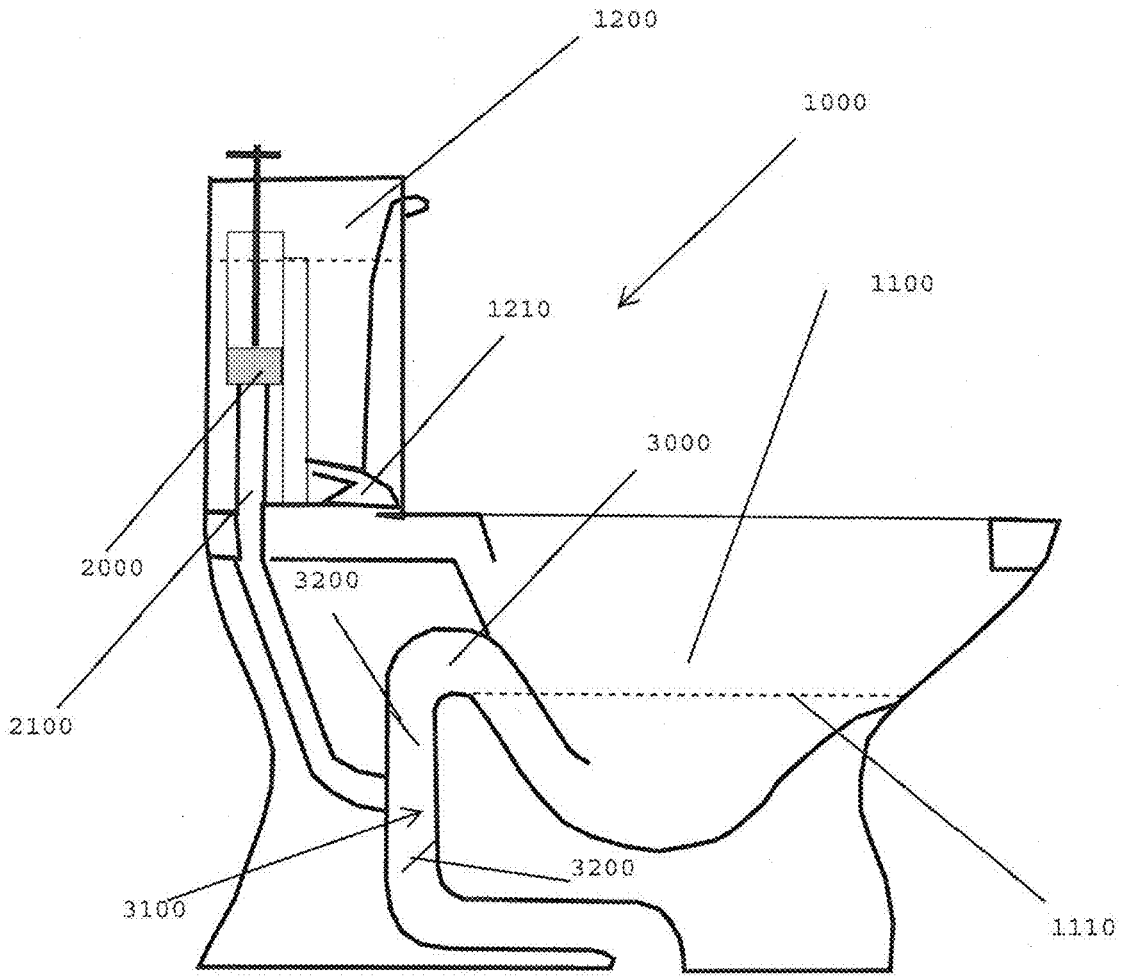
FIG. 6 is a cross-section of an embodiment of a flush toilet 1000 with built-in unclogging system.
Figure 7:
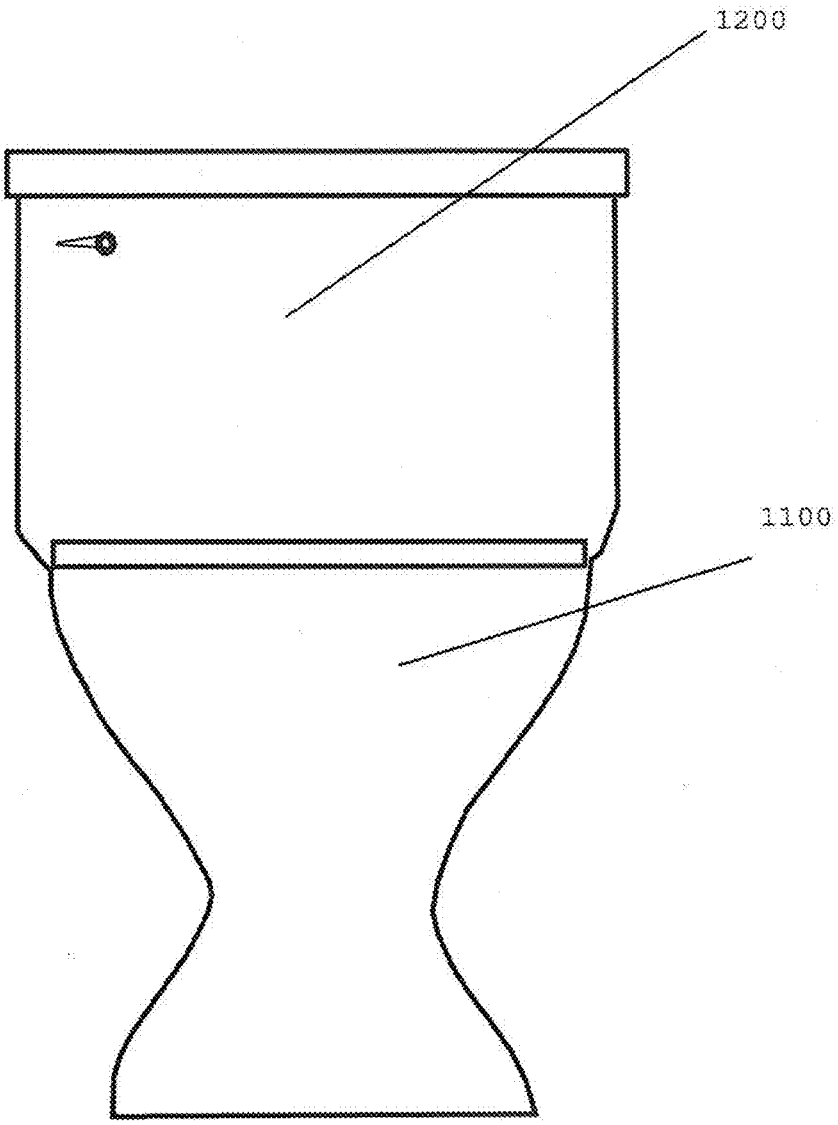
FIG. 7 is a front view of the toilet 1000 of FIG. 6.
Figure 8:
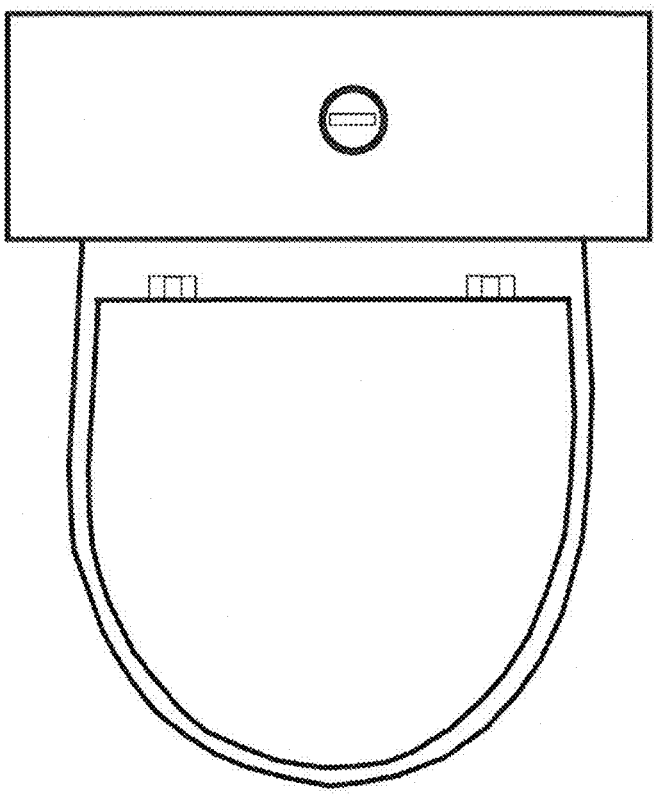
FIG. 8 is a top view of the toilet 1000 of FIG. 6.

FIG. 6 is a cross section of a flush toilet 1000 with a built-in clog removal system. FIGS. 7 and 8 are front and top views of the toilet 1000 shown in FIG. 6. Referring to FIGS. 6 through 8, the toilet 1000 is defined by a bowl 1100 that is coupled to a water tank 1200 and in fluid communication with a hollow and upside-down "U" shaped drain pipe 3000. As shown in FIG. 1, the water tank 1200 is vertically superior to the bowl and features an opening with a stopper 1210 wherein unstopping the opening causes water within the water tank 1200 to rapidly flow into the bowl 1100. Suitably, the bowl 1100 initially features a water level 1110 that does not empty through the drain 3000. Preferably, any rapid influx of water from the water reservoir 1200 into the bowl 1100 may increase the water level 1110 to result in a siphon through the U shaped drain 3000.

Still referring to FIG. 1, the toilet further comprises a pump 2000 that is in fluid communication with a downward portion 3100 of the U-shaped drain pipe 3000. In operation the pump may be used to cause fluid-flow (air or liquid) inside the downward portion 3100 of the drain pipe. In a preferred embodiment, the pump 2000 is a piston pump, which is provided to an air pipe 2100 that is coupled to the downward portion 3100 of the drain 3000. In said embodiment, a screen may be provided to the coupling of the air pipe with the drain so that debris may be prevented from entering the air pipe. It is contemplated, however, that any type of pump may be employed without departing from the spirit and intent of this disclosure.

As shown, the pump may be a piston pump for causing air flow (whether by force or suction) inside the downward portion 3100 (shown in FIG. 6) of the drain 2000. From time-to-time operations of the pump may not be necessary and, as a result, the pump may be stored in the downward, or compressed position during normal toilet use and operation.

Referring back to FIG. 6, the toilet 1000 comprises an upside-down "U" shaped drain pipe 3000 with a downward portion 3100. The pipe 3000 preferably features two or at least one one-way valve 3200. As shown, the pipe 3000 features two one-way valves in the downward portion 3100 of the pipe 3000. Suitably, the valves operate to open or close the drain pipe 3000. As discussed in greater detail below, the valves operate in response to fluid-flows (preferably air but may also be a liquid) generated via the pump 2000.

Figure 9:
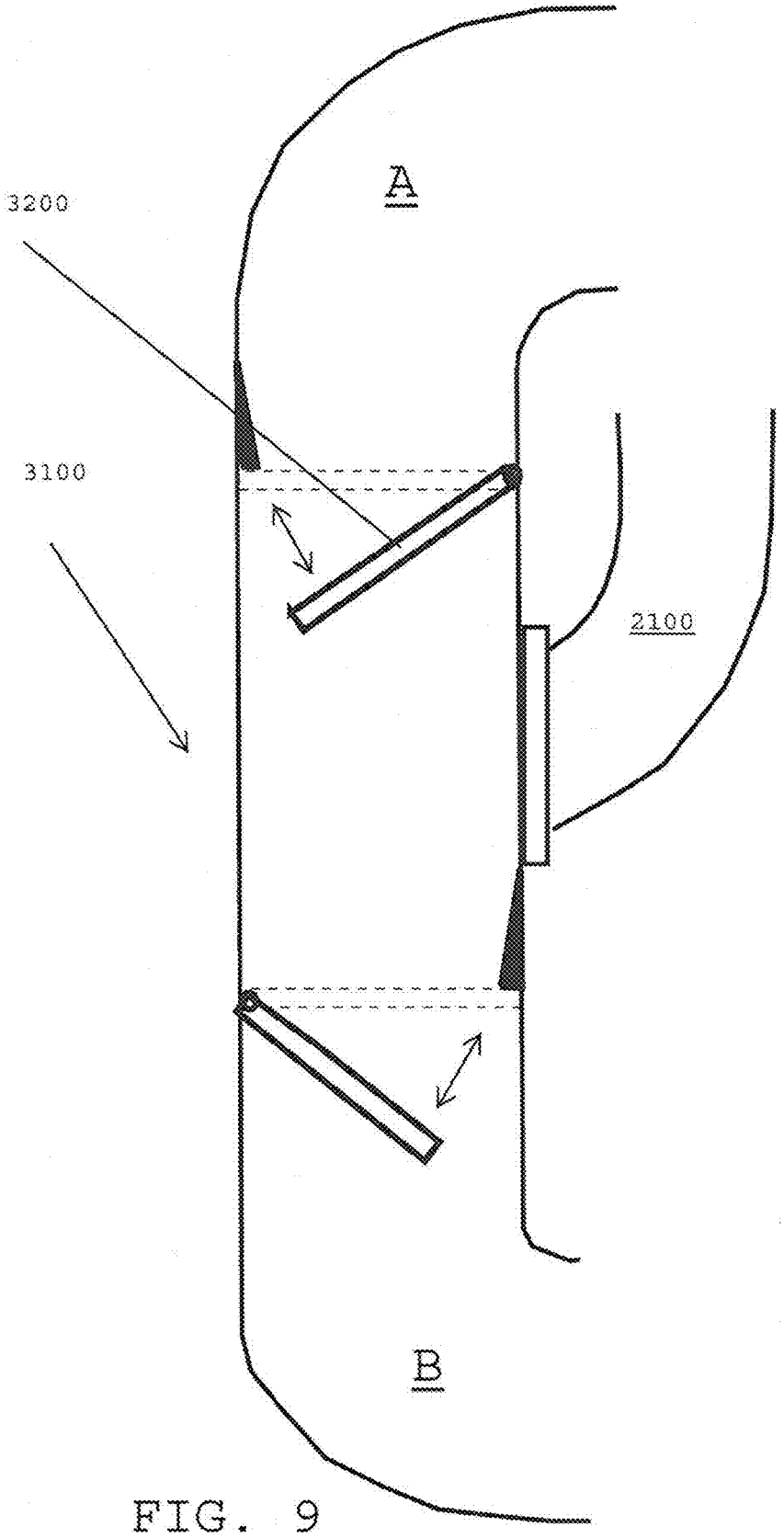
FIG. 9 is a cross section of a downward portion of a drain pipe.

FIG. 9 is a cross section of the downward portion 3100 of the drain pipe 3000. As shown, the drain features two one way valves, one at a level that is vertically superior to the coupling of the drain 3000 to the air-pipe 2100 of the pump, and one at a level that is vertically inferior to said coupling. When so configured, air flow from the pump 2000 through the air pipe to within the drain 3000 may close the vertically superior valve and, as a result, apply pressure to a clog occurring within the drain down system of the air pipe 2100. When so configured, fluid flow to the pump 2000 through the air pipe 2100 from within the drain may close (illustrated in broken lines in FIG. 9) the vertically inferior valve and, as a result, apply vacuum suction to a clog occurring within the drain up system of the air pipe.

In use, the toilet 1000 generally flushes in the manner known to those skilled in the art of flush toilets. Occasionally, the drain 3000 of the toilet 1000 may become clogged and the pump 2000 may be used to unclog the drain 3000. In a preferred mode of pump operation, the pump handle 2400 may be manipulated to drive air into the drain or draw air from the drain 3000 via the air pipe 2100. Suitably, clogs may be removed from the drain by repeatedly causing pressurizing or vacuumizing air flow in the drain 3000 via operation of the pump 2000. In other words, a clog may be pushed or pulled through the pipe to end the clog.

Exemplary Usage 1.

Referring to FIG. 9, a user may experience a clog at point A. To remove the clog, a user may use the pump handle 2400 to draw air from the drain 3000 via the air pipe 2100. Referring to FIG. 9, air flow from the drain 3000 (not shown in FIG. 9) to within the pump 2000 via the air pipe 2100 may close the lower valve 3200 and, as a result, apply vacuum suction to the clog A. Suitably, the clogs may be removed from the drain by repeatedly causing vaccumizing air flow in the drain via operation of the pump.

Exemplary Usage 2.

Referring to FIG. 4, a user may experience a clog at point B. To remove the clog B, a user may use the pump handle 2400 to force air into the drain 3000 via the air pipe 2100. Referring to FIG. 9, air flow from the pump 2000 to within the drain 3000 (not shown in FIG. 9 via the air pipe 2100 may close the upper valve 3200 and, as a result, apply pressure to the clog B. Suitably, the clogs may be removed from the drain by repeatedly causing forced air flow in the drain via operation of the pump.

Figure 10:
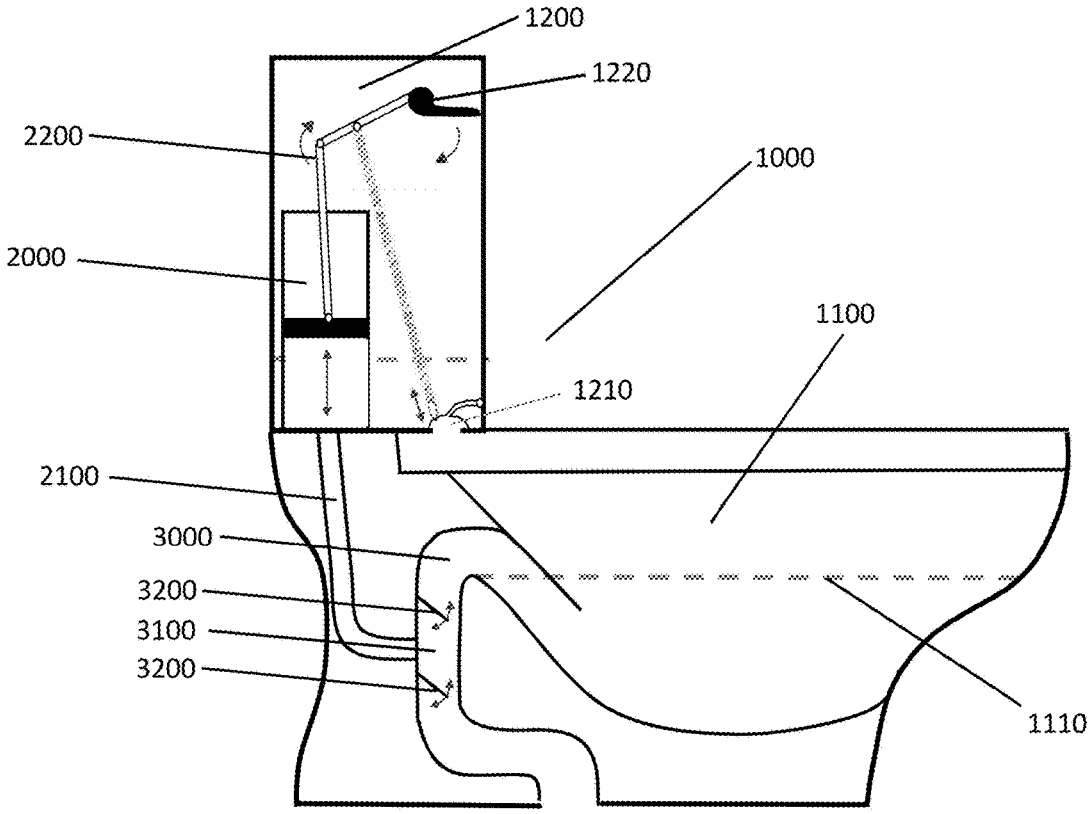
FIG. 10 is a cross-section of an alternative embodiment of a flush toilet with a one-way valve system.

FIG. 10 is a cross-section of one embodiment of a flush toilet 1000 with a one-way valve system that provides for efficient water-conserving operation. Referring to FIG. 10, in one embodiment, the toilet 1000 is defined by a bowl 1100 that may be coupled to a water tank 1200 and in fluid communication with a hollow and upside-down "U" shaped drain pipe 3000 with a downward portion 3100 of the pipe and at least one one-way valve 3200. The valves 3200 operate in response to fluid-flows (air or liquid) generated via the piston pump 2000. The pump 2000 provides fluid flows to the downward portion 3100 of the drain pipe via the air-pipe 2100. Furthermore, a lever 2200 can be connected to the piston pump 2000 and a handle 1220, so that when the handle 1220 is manipulated, the lever 2200 moves the piston pump 2000 upwards. The lever 2200 can also be coupled to a stopper 1210, which plugs the entry point where water from the tank 1200 to enter the bowl 1100.

In a conventional toilet, a substantial amount of water is necessary to initiate a flush. To initiate a flush, water needs to be poured from the tank into the bowl fast enough and with enough volume to fill the siphon tube and initiate the siphon action. After the water in bowl has emptied, water from the tank will fill into the bowl. Thus, the purpose of the tank is to get enough water into the bowl fast enough to activate a siphon action. This system can use a considerable amount of water to operate because enough water needs to be emptied into the bowl to initiate a flush and then more water is necessary to fill the bowl up to a certain height. This is in stark contrast to the action of the present invention.

This invention conserves water because, in one embodiment, it eliminates or significantly reduces the need for water to be poured into the bowl from the tank to initiate the siphon action, so that optimally, the only water that is being used is the amount to refill the bowl after it has been emptied. In short, when a user depresses the handle 1220, the piston in the piston pump 2000 will cause fluid flow (air or liquid) from the drain 3000 into the air pipe 2100. This will cause a one-way valve 3200 to open and create a vacuum on the water in the bowl 1100, initiating the siphon effect, which results in the toilet flush. The water in the tank 1200 will then be released into the bowl 1100 to refill the bowl 1100. Therefore, it is not necessary to pour water into the bowl to initiate the siphon effect, it is only necessary to pour water into the bowl to refill the bowl, thereby conserving water with each flush. In other embodiments, the siphon action to cause the flush can be initiated by a lesser volume of water by combining it with the action described herein.

Exemplary Usage 3.

Referring to FIG. 10, in one embodiment, the system of one-way valves 3200 placed within the drain 3100 may be used to initiate the flush of a toilet. In order to initiate the flush of a toilet, a user can first depress the handle 1220. Depressing the handle 1220 may cause the lever 2200 to articulate and move the piston in the piston pump 2000 upwards. Moving the piston in the piston pump 2000 upwards will cause fluid flow (air or liquid) from the drain 3000, into the air pipe 2100. As this occurs, the one-way valve 3200 that is vertically inferior to the air pipe 2100 will close and the one-way valve that is vertically superior to the air pipe 2100 will open. This action creates a vacuum on the water in the bowl 1100 and pull said water over the U-shaped drain 3000, thus initiating the siphon effect and causing the toilet to flush. At the same time, the lever 1220 is depressed to articulate the lever 2200, the stopper 1210, that is also connected to lever 2200, will open. Opening the stopper 1210 will release a small amount of water in the bowl 1100 to effectively clean and clear the debris or waste that may be lying above the water level 1110.

It should be noted that those of skill in the art may appreciate alternate embodiments of the invention after reading this disclosure. This description of a preferred embodiment is not intended to be a limit to the scope of this disclosure. On the contrary, applicant contemplates many alternative embodiments that may be contrived and used without departing from the spirit and intent of this written description.

The claims filed herewith are incorporated by reference in their entirety into the specification as if fully set forth herein.

I claim:

1. A method of conserving water comprising the steps of:

locating a flush toilet that features a bowl that is in fluid communication with a drain;

fixedly placing a one-way valve in the drain;

placing an air-pipe in fluid communication with the drain;

intersecting the air-pipe at a point along said drain that is upstream of the one-way valve;

using a pump to move air through said air-pipe and through the drain; and wherein a negative air pressure is created to efficiently pull water from the bowl down through the drain;

wherein the pump is a hand operated piston pump that is configured to move air through said air-pipe and through the drain.

2. The method of claim 1, wherein the pump is a piston pump located in a water tank of the toilet and coupled to a flush handle so that the piston pump moves air through said air-pipe and through the drain via articulation of the flush handle.

* * * * *